US009932147B1

(12) United States Patent
Ahlm et al.

(10) Patent No.: US 9,932,147 B1
(45) Date of Patent: Apr. 3, 2018

(54) TWO BOTTLE CONTAINER

(71) Applicant: PRIDE Industries, Roseville, CA (US)

(72) Inventors: Al Ahlm, Roseville, CA (US); Steve Twitchell, Roseville, CA (US)

(73) Assignee: PRIDE Industries, Roseville, CA (US)

( * ) Notice: Subject to any disclaimer, the term of this patent is extended or adjusted under 35 U.S.C. 154(b) by 0 days.

(21) Appl. No.: 14/957,305

(22) Filed: Dec. 2, 2015

(51) Int. Cl.
*B65D 21/02* (2006.01)
*B65D 69/00* (2006.01)

(52) U.S. Cl.
CPC ..... *B65D 21/0237* (2013.01); *B65D 69/00* (2013.01)

(58) Field of Classification Search
CPC ..... B65D 21/0237; B65D 21/02; B65D 21/0204; B65D 69/00; B65D 21/0234; B65D 21/0235; B65D 21/0233; B65D 21/04; B65D 21/0201
USPC ..... 215/237, 2, 204, 1 R, 1 C, 6, 10, 383, 215/385, 382; 206/457, 507, 505; 220/23.83, 219, 221, 223, 23.89, 23.87, 220/23.4, 23.2; 222/94
See application file for complete search history.

(56) References Cited

U.S. PATENT DOCUMENTS 3,443,726 A 5/1969 Muller et al.
4,235,343 A * 11/1980 Thompson ..... B65D 21/0237 215/10
4,823,946 A 4/1989 Stoeffler et al.
4,925,066 A * 5/1990 Rosenbaum ..... B05B 11/0037 215/10
D338,824 S * 8/1993 Chen ..... D9/516
5,277,303 A 1/1994 Goyet et al.
5,669,519 A * 9/1997 Notz ..... B65D 21/0237 206/504
2009/0308889 A1* 12/2009 Lindsay ..... B05B 11/0005 222/129
2015/0284150 A1* 10/2015 Doubles ..... B65D 41/26 222/1

* cited by examiner

*Primary Examiner* — Anthony Stashick
*Assistant Examiner* — James M Van Buskirk
(74) *Attorney, Agent, or Firm* — Pillsbury Winthrop Shaw Pittman LLP

(57) ABSTRACT

According to certain aspect, the present invention provides a two-bottle package design comprising a first bottle and a second bottle. The second bottle can be frictionally inserted into an opening in the middle of the first bottle during normal storage and separated from the first bottle for mixing before actual application of the stored products. In one embodiment, the package comprises a first bottle to contain a liquid product and the second bottle to contain a concentrate refill of the first product. In another embodiment, the package comprises a first bottle to contain the first product, and a second bottle to contain a second product to be mixed with the first product before actual application of the mixture.

14 Claims, 7 Drawing Sheets

TWO BOTTLE CONTAINER

RELATED APPLICATIONS

This utility patent application is related to U.S. Design application Ser. No. 29/547,311 filed Dec. 2, 2015 entitled "Two Bottle Container Package", which application is incorporated herein by reference.

FIELD OF THE INVENTION

The present invention relates generally to a container package or assembly having two bottles allowing separate storage and/or mixing of products, and more particularly to an improved storage container having a smaller bottle that can be inserted into an opening of a larger bottle.

BACKGROUND OF THE INVENTION

A wide variety of plastic material bottles are used for storing and dispensing a wide variety of chemical products such as cleaning liquids or pesticide. For applications where a concentrate solution can be housed within a smaller container and housed within the larger, ready-to-use container, or where two components must be isolated from each other before being mixed to form a ready-to-use preparation, packaging or assembly with two plastic bottles are used or envisaged. For example, U.S. Pat. No. 3,443,726 disclosed a container consisting of two container sections which are threadably engaged and are designed to be screwed into one another. This container however can only be handled as a single unit because the upper container section is only closed by insertion of the lower bottle/section with a stopper in between to prevent the mixing of the contents. U.S. Pat. No. 4,823,946 discloses an improved two-compartment container consisting of two separately Tillable bottles designed to be fitted together one above the other through an intermediate component. Although this two-compartment container can be filled and sealed independently of one another and can be stored, handled and supplied separately from and independently of one another as filled individual components, the intermediate connecting component requires a large pitch thread on the neck of the second bottle for it to be easy to use. U.S. Pat. No. 5,277,303 disclosed a two bottle packaging that further improves the intermediate connecting component of the two-compartment container of U.S. Pat. No. 4,823,946 so that the lower bottle can be made of glass instead of only plastic due to the large pitch thread required in U.S. Pat. No. 4,823,946.

All of the above two bottle packaging or assembly, however, still require complicated connecting or linking means to keep the two bottles together.

SUMMARY OF THE INVENTION

According to certain aspects, the present invention provides a two-bottle container package design that solves the above identified problem. The container package or assembly of the present invention comprises a first bottle and a second bottle, wherein the second bottle can be frictionally inserted into the first bottle. The first bottle is dimensioned to have an opening in the middle of the body that defines an open space and a handle. The second bottle is smaller than the first bottle and dimensioned so that the second bottle can be frictionally inserted into and removed from the opening of the first bottle.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Moreover, applicants do not intend for any term in the specification or claims to be ascribed an uncommon or special meaning unless explicitly set forth as such. Further, the present invention encompasses present and future known equivalents to the known components referred to herein by way of illustration.

This application discloses a container package or assembly design that has two separable bottles of different sizes. The smaller bottle of the container design can be frictionally inserted into and removed from an opening of the larger bottle. The disclosed solution has the following advantages over the existing two-bottle package.

First, by having the smaller bottle frictionally inserted into the opening of the larger bottle, the disclosed solution does not require any additional component to keep the two bottles together thus makes it as economical as possible to manufacture. Second, this solution also saves a customer the trouble having to actually measure the contents of the two bottles to get the mixing ratio right, since the cap of the smaller and/or larger bottler of the body or the bottles themselves may be marked, sized or otherwise configured to provide a guide for specific measurement of concentrated solution to be added to the larger bottle for refill purposes, thereby eliminating the need for an independent means of measurement. Third, the nested design also saves shelf space because it takes the shelf space of one bottle as opposed two.

Figure 1:
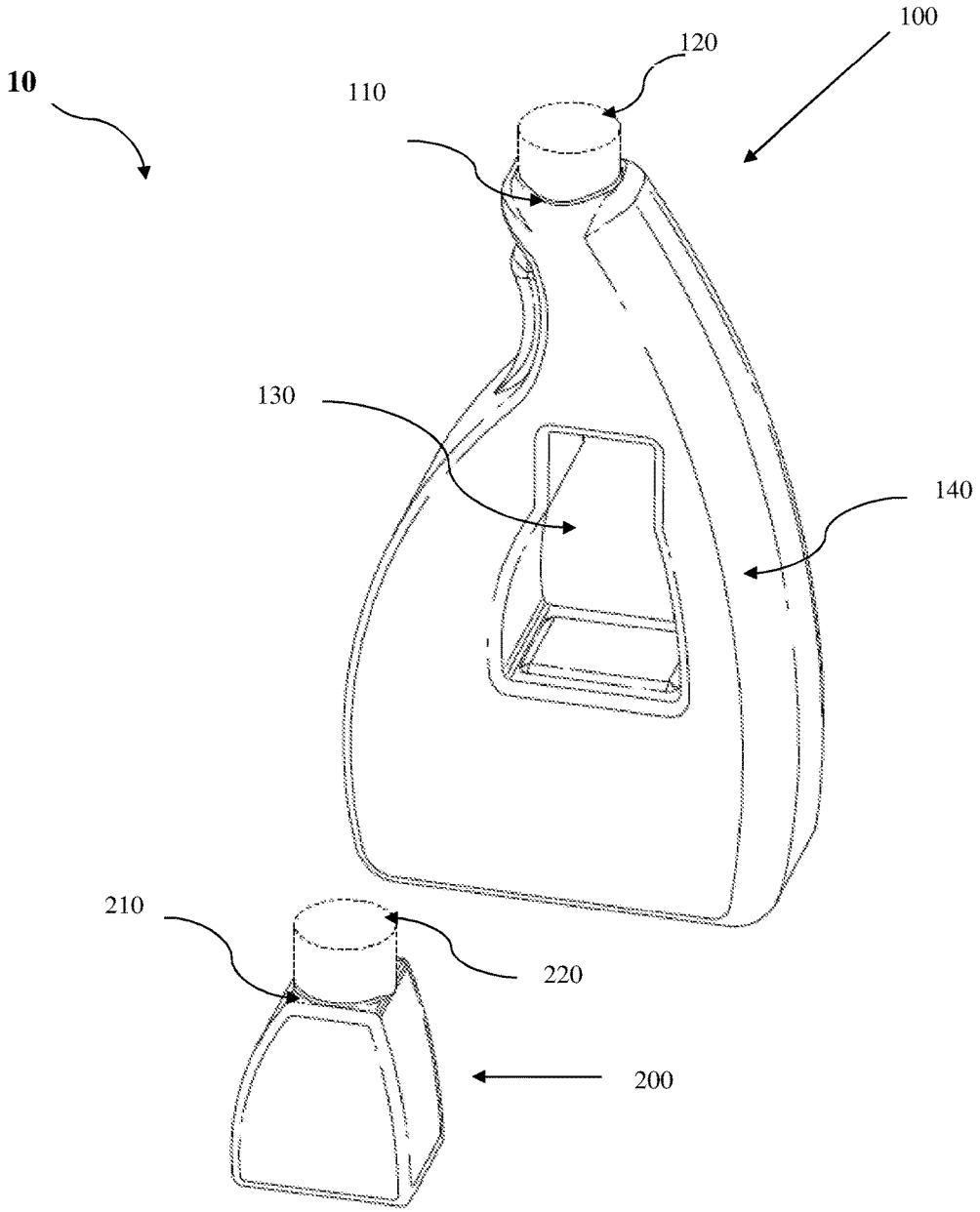
FIG. 1 illustrates a first bottle and a second bottle of the two-bottle package standing separately according to one aspect of the present invention.

FIG. 1 shows the larger bottle 100 and the smaller bottle 200 of a two-bottle assembly 10 according to an embodiment of the present invention. The two-bottle assembly is also referred to as "container package" in the specification and claims. As shown, bottle 100 has a top opening 110 for filling or dispensing of a first material and a cap 120 for closure. Bottle 100 has an opening 130 in the middle of the body that also defines a handle 140. As shown, bottle 200 also has a top opening 210 for filling and dispensing a second material and a cap 220 for closure. Note that the first material to be dispensed and the second material to be dispensed may be the same material or different materials. For clarity, the bottle 100 and bottle 200 are shown as empty bottles without the first material or second material stored in them.

Figure 2:
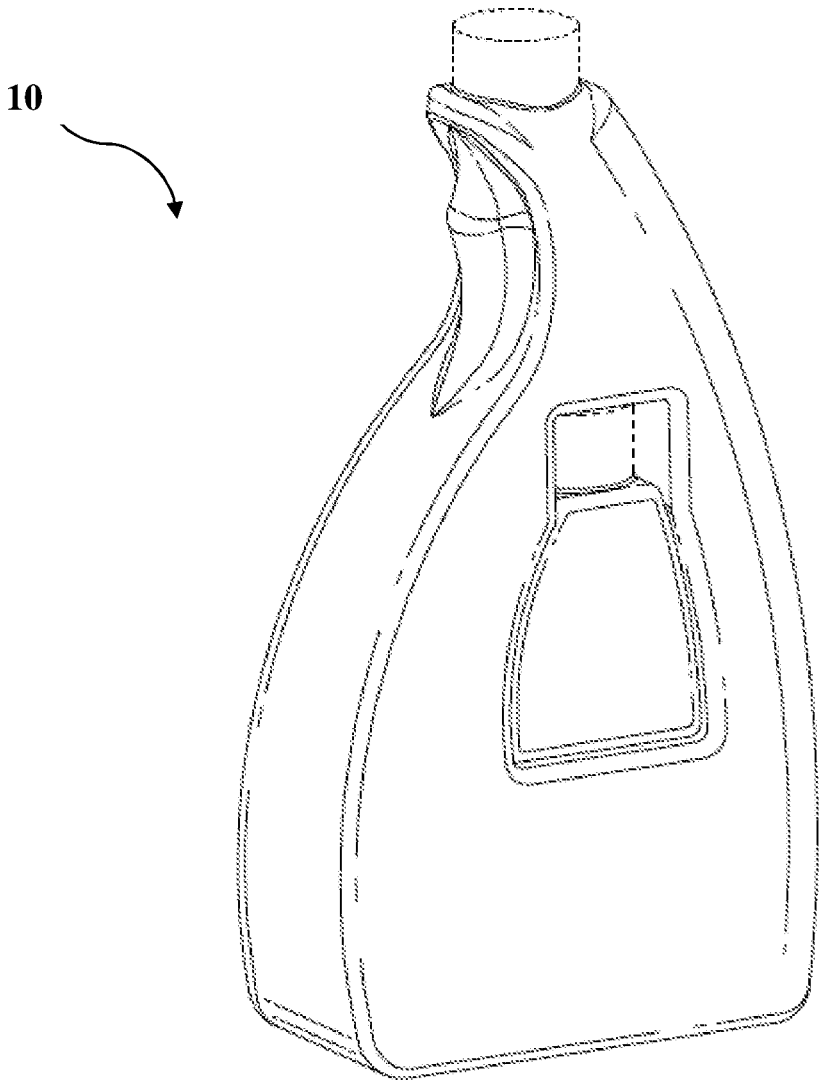
FIG. 2 illustrates the second bottle inserted into the first bottle of the two-bottle package according to another aspect of the present invention.

FIG. 2 depicts how the two-bottle assembly 10 looks like when bottle 200 is fully inserted into the opening of the 110 of bottle 100.

As shown in both FIGS. 1 and 2, both bottle 100 and bottle 200 have round top openings with round cap 120 and round cap 220. It should be noted however, that the top openings of the two bottles may have a geometric shape other than round. For example, the openings can be oval. It should also be noted that the top openings of the two bottles do not need to have the same shape.

In some embodiments, cap 120 and cap 220 may be plastic screw caps. According to another embodiment, cap 120 and cap 220 may be a flip-top.

In some embodiments, cap 120 and cap 220 may be completely removable from bottle 100 and bottle 200 respectively. In other embodiments, cap 120 and cap 220 may be connected to bottle 100 and bottle 200 through a thin plastic band to avoid getting lost.

In some embodiments, instead of a regular cap 120 as depicted in FIG. 1, bottle 100 may use a generic sprayer attachment for spraying the content therein. The generic spraying attachment is not shown in the drawings for clarity, but an example of a generic spraying attachment is shown as element 20 in FIG. 1 in US Publication No. 2009/0308889, titled, "Container System," by Lindsay et al. Element 20 is described as a trigger-spray device in US 2009/0308889.

The first bottle may be used to store a first product and the second bottle may be used to store a second product, which needs to be stored separately from the first product. The first product may be in one of the forms consisting of liquid, paste, or solid such as powder or grains. As a non-limiting example, the first product can be an oxidizer in paste form used to mix with an oxidizing chemical in liquid form in the second bottle for purpose of hair coloring.

In some applications, the first bottle may be used to store a first product, and the second bottle may be used to store the concentrate refill of the first product. For example, the first bottle may be used to store dish washing detergent and the second bottle may be used to store the concentrate refill of the dish washing detergent. Once the dish washing detergent in the first bottle is used up, the concentrate refill stored in second bottle can be poured into the first bottle and then just adding water to fill up the first bottle will generate in the first bottle a properly diluted dish washing detergent.

It is preferred that the minimal volume of the smaller bottle is at least as large at the amount of liquid needed for a single usage (i.e., a single load of washing detergent).

In some applications, the smaller bottle, its cap, or body can be marked with concentrate levels and/or dilution rates and can be used as a measuring device as opposed to or in addition to storage.

Figure 3:
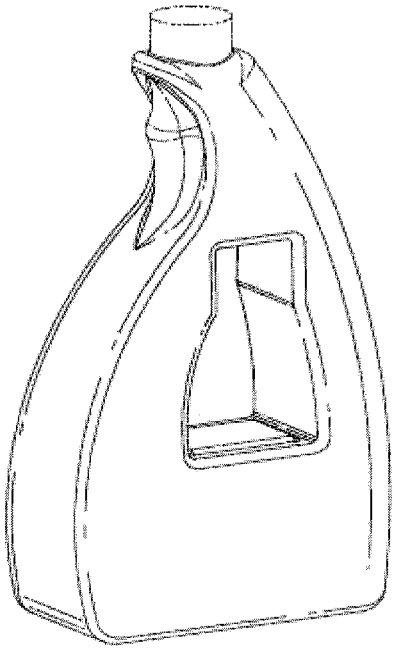
FIGS. 3-8 depict various views of the first bottle according to an embodiment of the invention.

Turning to FIG. 3, it shows a prospective view of the larger bottle 100.

Figure 4A:
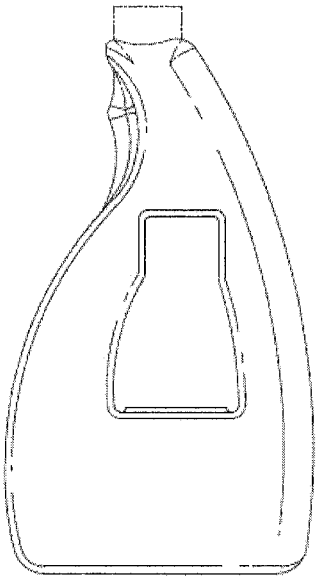
Figure 4B:
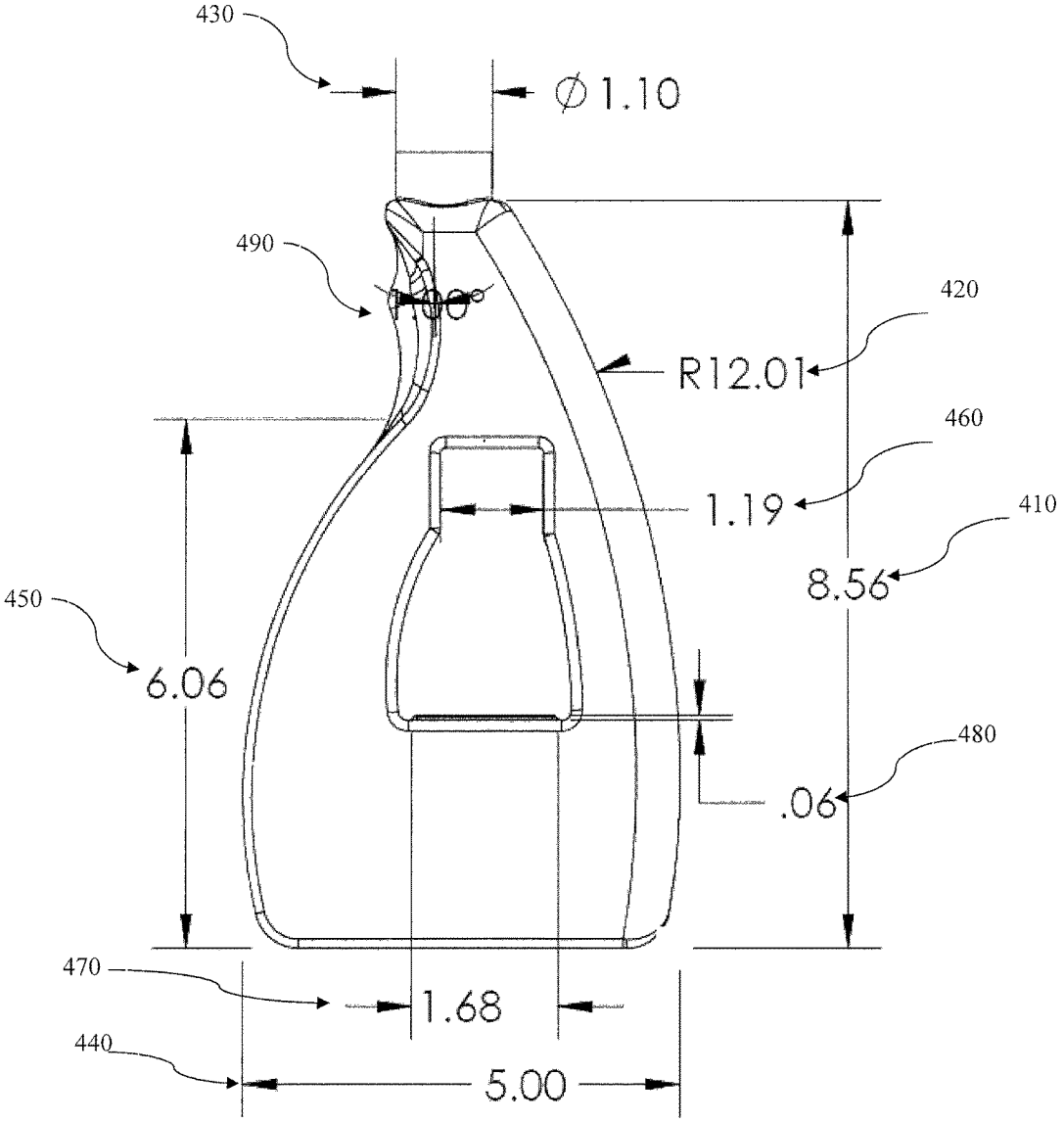

FIG. 4A is a front view of a first bottle (bottle 400) and FIG. 4B depicts the corresponding front view of a preferred embodiment of bottle 400. As shown in FIG. 4B, the height (410) of bottle 400 measures about 8.56 inch. The handle of bottle 400 is curvy on the exterior surface, which curve (420) has a radius of about 12.1 inch. The diameter of the cap (430) is 1.1 inch. The rectangular base of bottle 400 measures about 5 inch wide (450).

FIG. 4B also depicts the location of the opening space in the middle of bottle 400 for the smaller bottle. As shown, the top of the opening space in the middle of the bottle to the base of bottle 400 is about 6.06 inch (450). The top of the opening is about 1.19 inch in diameter (460). The bottom of the opening is rectangular. The central area of the surface of the bottom of the opening space is also rectangular and slightly raised for about 0.06 inch (480) above the surrounding surface area. The raised rectangular surface of the base is about 1.68 inch wide (470). This raised smaller surface adds the friction needed to keep the smaller bottle in place when inserted. It is noted that bottle 400 also has a ribbed and/or tapered neck design (490) that is for easy grip when the smaller bottle is inserted in the opening space.

Figure 5A:
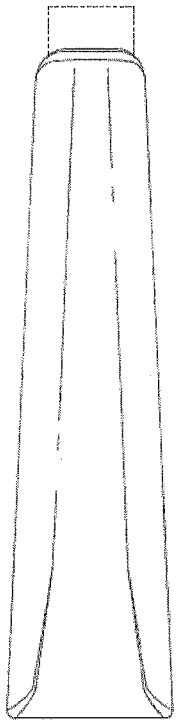
Figure 5B:
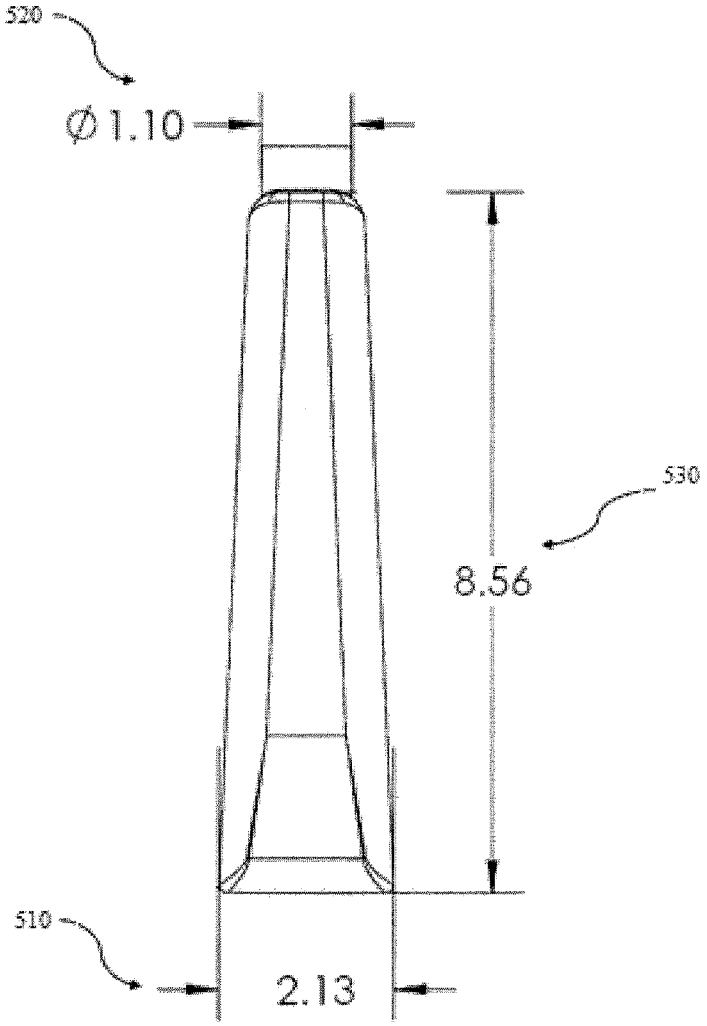

FIG. 5A is a right side view of the larger bottle that directly shows the exterior surface of the handle (520). FIG. 5B depicts the corresponding front view of a preferred embodiment of the larger bottle. As shown, the width of the rectangular base (510) measures about 2.13 inch. The height of the bottle (520) is about 8.56 inch measured from edge of the cap to the base. The diameter of the cap (530) is about 1.1 inch.

Figure 6:
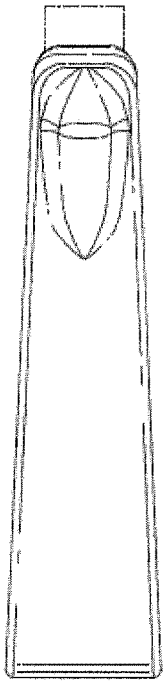
Figure 7:
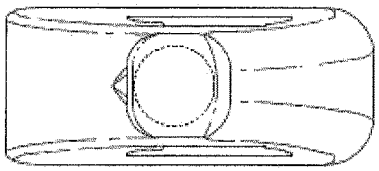
Figure 8:
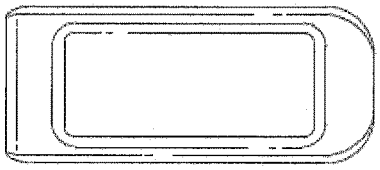

FIG. 6 is a left side view of the larger bottle 600 according to a preferred embodiment of the present invention. FIG. 7 is a top view of the larger bottle according to a preferred embodiment of the present invention. FIG. 8 is the bottom view of the larger bottle.

Figure 9:
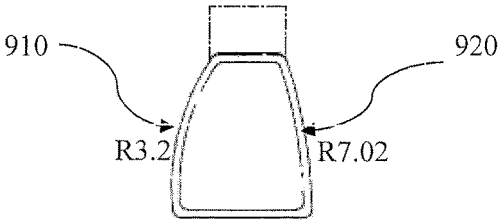
FIGS. 9-12 depict various views of the second bottle according to an embodiment of the invention.

FIG. 9 is a front view of a preferred embodiment of the smaller bottle according to the present invention. As shown, the left exterior surface (910) is curvy having a radius of about 3.2 inch and the right exterior surface (920) is curvy having a radius of about 7.02 inch.

Figure 10:
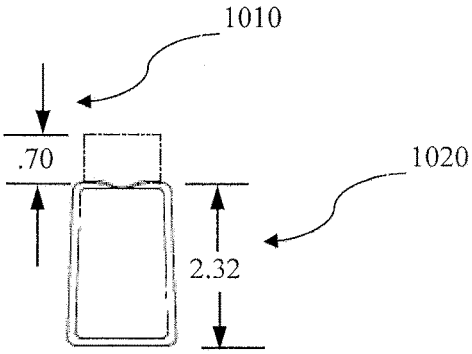

FIG. 10 is the right side view and the left side view of a preferred embodiment of the smaller bottle according to the present invention. The height (1010) of the neck is 0.7 inch. The height (1120) of the smaller bottle is 2.32 inch.

In some embodiments, the left side view of the smaller bottle is the same as that of the right side view. In some embodiments, the left side of the smaller bottle may have markings on the surface for measurement purposes.

Figure 11:
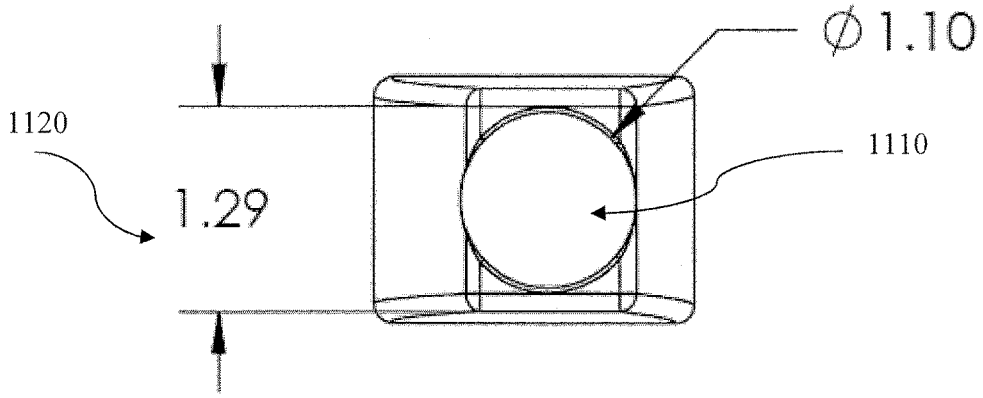

FIG. 11 is the top view of a preferred embodiment of a smaller bottle 1100 according to the present invention. As shown, the diameter (1110) of the cap measures about 1.10 inch, and the width of the square surface (1120) of top is about 1.29 inch.

Figure 12:
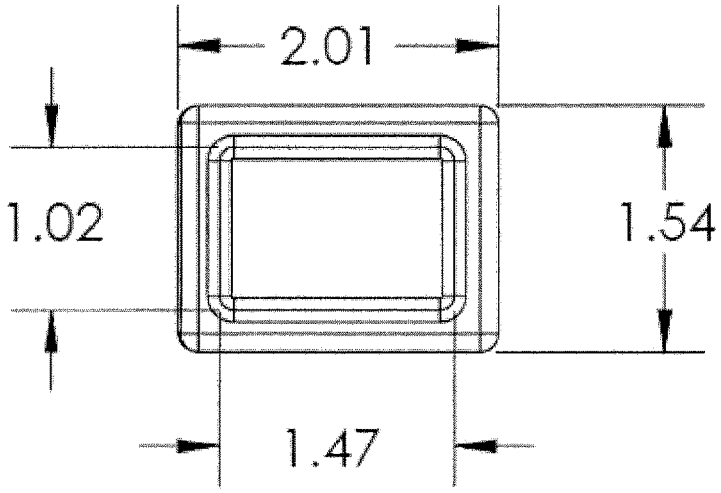

FIG. 12 is the bottom view of a preferred embodiment of a smaller bottle 1200 according to the present invention. As shown, the base of bottle 1200 has a rectangular shape with the outer edge measures about 2.01 inch long and about 1.54 inch wide. In the center, there is an concentric rectangular indent that measures about 1.47 inch long and about 1.02 inch wide. This indented surface is designed to frictionally wrap around the raised surface at the bottom of the opening of the larger bottle as discussed. This design allows additional friction to secure the smaller bottle when inserted.

It should be noted that different materials can be used for making bottles discussed above, such as plastic, glass, metal. However, plastic is the preferred material to use in making these bottles not only because it is economical but also because it is malleable so that the smaller bottle can be frictionally inserted in the opening.

It should also be noted that in the above description, the shape and form of the two bottles is not limited to that as depicted in FIGS. 1-12. The smaller bottle can be of any form or shape as long as it can be frictionally inserted into the opening of the larger bottle. For example, the smaller bottle can be a cube/rectangular/pyramid container inserted into a larger cube/rectangular/pyramid container.

Alternatively, the larger bottle may also have spraying capability. As shown in FIGS. 1-4, the larger bottle has a ribbed and/or tapered neck design for easy grip.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. A container package for storing a material, comprising:

a first bottle, wherein the first bottle has an opening in the middle of the body that defines an open space, wherein the open space is defined by a plurality of surfaces within outer contours of the first bottle, including a rectangular top surface, a rectangular bottom surface having a rectangular raised portion at the center, a right surface comprising a curved section and a flat section, and a left surface comprising a curved section and a flat section, wherein a portion of the first bottle on the right of the open space constitutes a handle that includes the curved section and the flat section of the right surface; and a second bottle, wherein the second bottle is smaller than the first bottle, has a shape corresponding to the shape of the open space of the first bottle, has a vertical axis parallel to a vertical axis of the first bottle, and is dimensioned such that the second bottle can be frictionally inserted into or removed from the open space of the first bottle, such that after frictional insertion, the second bottle is enclosed by the first bottle from the top, bottom, right and left, leaving the front and the back sides unenclosed, with a right exterior surface and a left exterior surface of the second bottle aligned respectively with the curved sections of the right surface and left surface defining the open space, the right exterior surface of the second bottle having a curvature different from a curvature of the left exterior surface of the second bottle, and, a rectangular base of the second bottle having an indented portion that frictionally engages with the raised portion of the rectangular bottom surface defining the open space of the first bottle.

2. The container package of claim 1, wherein the first bottle has an opening on the top for filling or dispensing the material with a first cap for closure and the second bottle has an opening on the top for filling in and dispensing the material with a second cap for closure.

3. The container package of claim 2, wherein the opening on the top of the first bottle is round and the base of the first bottle is rectangular.

4. The container package of claim 2, wherein the opening on the top of the second bottle is round.

5. The container package of claim 1, wherein the second bottle is dimensioned to have its front and back surfaces flush with the front and back surface of the first bottle respectively when the second bottle is fully inserted into the open space of the first bottle.

6. The container package of claim 2, wherein the first cap and the second cap are removable.

7. The container package of claim 2, wherein the first cap is configured to allow use of a generic sprayer attachment.

8. The container package of claim 2, wherein the second cap is used as a measuring device for material stored in either the first bottle or the second bottle.

9. A container package for storing a first material and a second material that are to be stored separately from each other and to be mixed at the time of use, comprising:

a first bottle for containing the first material, wherein the first bottle has an opening in the middle of the body that defines an open space, wherein the open space is defined by a plurality of surfaces within outer contours of the first bottle, including a rectangular top surface, a rectangular bottom surface having a rectangular raised portion at the center, a right surface comprising a curved section and a flat section, and a left surface comprising a curved section and a flat section, wherein a portion of the first bottle on the right of the open space constitutes a handle that includes the curved section and the flat section of the right surface;

a second bottle for containing the second material, wherein the second bottle is smaller than the first bottle, has a shape corresponding to the shape of the open space in the first bottle, has a vertical axis parallel to a vertical axis of the first bottle, and is dimensioned to be frictionally inserted in the open space of the first bottle, such that after frictional insertion, the second bottle is enclosed by the first bottle from the top, bottom, right and left, leaving the front and the back sides unenclosed, with a right exterior surface and a left exterior surface of the second bottle aligned respectively with the curved sections of the right surface and left surface defining the open space, the right exterior surface of the second bottle having a curvature different from a curvature of the left exterior surface of the second bottle, and, a rectangular base of the second bottle having an indented portion that frictionally engages with the raised portion of the rectangular bottom surface defining the open space of the first bottle.

10. The container package of claim 9, wherein the volume of the first bottle and the second bottle are such that the ratio of the first material to the second material is proper for a desired mixed product that results when the first material and the second material are mixed at the time of use.

11. The container package of claim 9, wherein the first material is selected from a group consisting of liquid, gas, powder and other solid material.

12. The container package of claim 9, wherein the second material is concentrate refill of the first material.

13. The container package of claim 12, wherein the ratio between the volume of the second bottle and the first bottle is the proper ratio between the amount of the concentrate refill of the first material stored in the second bottle and the amount of properly diluted first material stored in the first bottle.

14. The container package of claim 9, wherein the second material is selected from a group consisting of liquid, gas, powder and other solid material.

* * * * *